United States Patent [19]

Sanno

[11] Patent Number: 4,770,354

[45] Date of Patent: Sep. 13, 1988

[54] COP MAGAZINE FOR AUTOMATIC WINDING APPARATUS

[75] Inventor: Hiroaki Sanno, Nonoichi, Japan

[73] Assignee: Murao Boki Kabushiki Kaisha, Kanazawa, Japan

[21] Appl. No.: 32,553

[22] Filed: Apr. 1, 1987

[30] Foreign Application Priority Data

Apr. 14, 1986 [JP] Japan ..... 61-85681

[51] Int. Cl.[4] ..... B65H 54/22; B65H 67/06

[52] U.S. Cl. ..... 242/35.5 R; 242/35.5 A; 242/35.6 R

[58] Field of Search ..... 242/35.5 R, 35.5 A, 242/35.6 R, 35.6 E, 18 R

[56] References Cited

U.S. PATENT DOCUMENTS

| | | | |
|---|---|---|---|
| 3,261,562 | 7/1966 | Kupper | 242/35.6 R |
| 3,265,316 | 8/1966 | Furst | 242/35.6 R |
| 3,480,216 | 11/1969 | Iannucci et al. | 242/35.5 R X |
| 4,558,829 | 12/1985 | Aretz | 242/35.5 A |
| 4,589,602 | 5/1986 | Reiners et al. | 242/35.5 R |
| 4,664,326 | 5/1987 | Grecksch et al. | 242/35.5 R X |

*Primary Examiner*—Stanley N. Gilreath

*Attorney, Agent, or Firm*—Oblon, Fisher, Spivak, McClelland & Maier

[57] ABSTRACT

A cop magazine for use in association with an automatic winding apparatus the cop magazine including an open-topped cylindrical drum; a tube creel provided inside the cylindrical drum, the creel including cells adapted to house a plurality of cops individually; a rotating member for rotating the tube creel intermittently cop by cop; a suction cap provided at the top end of a suction pipe passed through the tube creel, the suction cap including a slit faced to the delivery-ready position and the delivery position in the tube creel; and a rotary blade for opening and closing the slit so as to release and retain the yarns, the rotary blade being operable in association with the rotation of the tube creel. This structure provides a cop magazine having a simplified construction whereby the yarn ends leading from the cops are retained under suction during movement of the cops from the magazine to the winder.

8 Claims, 4 Drawing Sheets

COP MAGAZINE FOR AUTOMATIC WINDING APPARATUS

BACKGROUND OF THE INVENTION

1. Field of the Invention

The present invention relates to a cop magazine for use in association with an automatic winding apparatus, the cop magazine including a device for holding the yarns under suction while the respective cops are delivered to the automatic winding apparatus, thereby facilitating the winding operation.

2. Description of the Prior Art

It is known in the art that several cops are stored in the cells of a cylindrical cop magazine attached to the automatic winding apparatus. Every time the cell in the magazine is emptied the magazine is rotated by one pitch so that the next cop is made ready to deliver. In the known cop magazines the operator must find the end of the yarn leading from each cop and pull it by hand so as to retain the yarns on a retainer device under suction. This requires a lot of manual labor.

To facilitate the pulling of the yarns one way is to fix the yarn ends to the respective bobbins beforehand by winding them around the rims of the bobbins or by inserting them through the bobbon bores; recently the latter method being popular. To practice these methods a special device must be utilized. For the known cop magazines the provision of such a device is proposed for automatically pulling the yarn ends and leading them into a retainer device housed in the magazine.

In order to explain the known winding apparatus reference will be made to FIGS. 1 to 4:

The winding apparatus shown in FIG. 1 includes several yarn winding sections 2 in opposition to which the same number of cop magazines 4 are provided. Each winding section 2 receives the yarns leading from the cop 5*a* delivered from the magazine 4. When the yarn on the cop 5*a* is emptied a yarn binding device 3 stops its reciprocal movement effecting throughout the winding section 2, and the magazine 4 is rotated by one pitch so as to deliver the next cop. The yarns from the package 2*a* and from the delivered cop 5*a* are tied.

The cop magazine 4 has a tube creel 11 concentric of the cylindrical body 4*a*, which has the cells for housing the cops 5; in the illustrated magazine six cells are provided. The cell is a bore produced vertically through the cylindrical body of the magazine 4. Each cylindrical body 4*a* has a recess 4*b* through which the body 4*a* is communicated with a chute 6. The tube creel 11 is rotated pitch by pitch, for example, by 60° increments in the counter-clockwise direction, thereby allowing the cops 5 to be delivered therethrough. The reference number 5*b* designates a cop situated at a delivery-ready position. The tube creel 11 is provided with a cover 7 (FIG. 2) at its upper section, the cover being connected to a suction pipe 14 (FIG. 6) and swingable on an axis indicated by the dotted line. The cover 7 includes suction port 7*a* kept so as not to be normally in alignment with the suction pipe 14. When they are to be aligned, the cover 7 is rotated by hand or by any other means. Then the yarn end of the cop 5 is retained at the suction port 7*a*, wherein at this stage the cop 5 is delivered through the recess 4*b*. The arm 3*c* pulls the yarn ends, and binds them. After they are cut the resulting yarn odds and ends are removed through the suction pipe 14 by aligning the suction port 7*a* with the open end of the pipe 14.

As is evident from the foregoing description it is necessary to find the yarn end of each cop 5 stored in the magazine 4 and retain it at the cover 7 by hand. To avoid this manual labor a cop magazine is devised so as to automatically lead the yarn end into the suction port 7*a*, wherein the yarns are previously inserted through the bobbin bores. For an explanation in greater detail reference will be made to FIGS. 3 and 4:

In FIG. 3 the cover 7 is provided with suction pipe 8 curved so as to extend over the suction port 7*a* and the cop delivery position or the cop housed in the preceeding cell. The yarn is sucked through the suction port 7*a*, and retained therein.

FIG. 4 shows another modified version, characterized in that a special suction and a retention duct 9 is provided at each cop magazine in such a manner as to extend over the delivery-ready position and the delivery position. Under the duct 9 there is provided a suction port which is covered by a plate 10 capable of opening and closing by a pin fixed to the cover 7. The plate 10 is closed and opened in the same manner as the suction port 7*a*.

The cylindrical body 4*a* is provided with a stop means (not shown) and a yarn end support (not shown) in the recess 4*b*, the former being intended to prevent the bobbins from further advancing and the latter being intended to support the yarn ends.

In the regular cleaning of the winding apparatus or in the replacement of parts it is necessary to detach the cop magazines therefrom but in the known apparatus the parts are of complicated assembly, thereby resulting in prolonged cleaning time. There is a proposal for adapting the known cop magazines shown in FIG. 2 but this results in a complicate and expensive structure.

SUMMARY OF THE INVENTION

The present invention aims at solving the problems pointed out above, and has for its object to provide a cop magazine having a simplified structure under which the yarn ends leading from the cops are retained under suction during the movement of the cops from the magazine to the winder.

Other objects and advantages of the present invention will become more apparent from the following detailed description, when taken in conjunction with the accompanying drawings which shows, for the purpose of illustration only, one embodiment in accordance with the present invention.

BRIEF DESCRIPTION OF THE INVENTION

DESCRIPTION OF THE PREFERRED EMBODIMENTS

Figure 1:
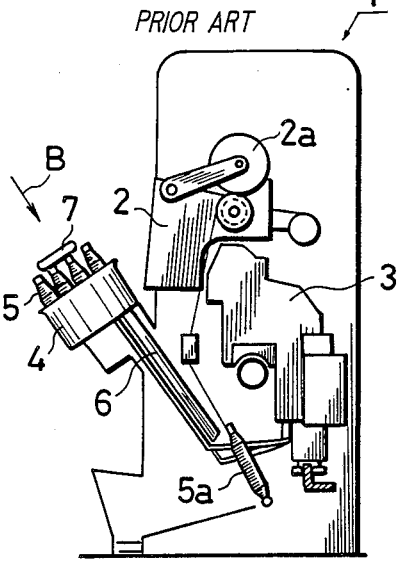
Fig. 1 PRIOR ART
FIG. 1 is a diagrammatic side view showing a known automatic winding apparatus.
Figure 2:
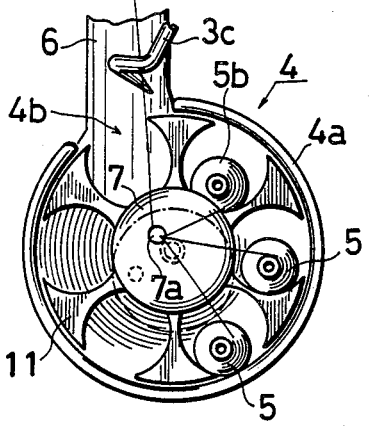
Fig.2 PRIOR ART
FIG. 2 is a plan view of the cop magazine shown in FIG. 1, when it is viewed in the direction of arrow (B)
Figure 3:
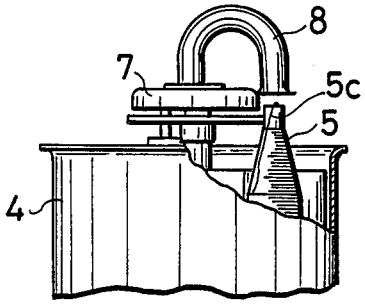
Fig.3 PRIOR ART
FIG. 3 is a side view of another example of the known cop magazines.
Figure 4:
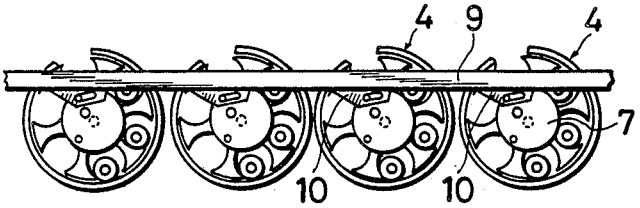
Fig.4 PRIOR ART
FIG. 4 is a diagrammatic plan view of a further example of the known cop magazines.
Figure 5:
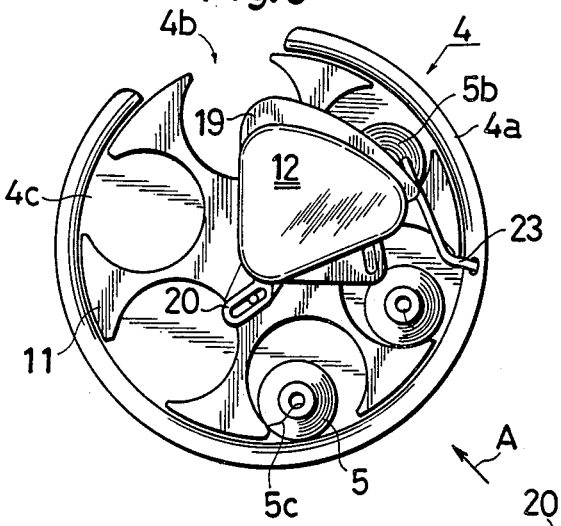
FIG. 5 is a plan view of a cop magazine embodying the present invention.
Figure 6:
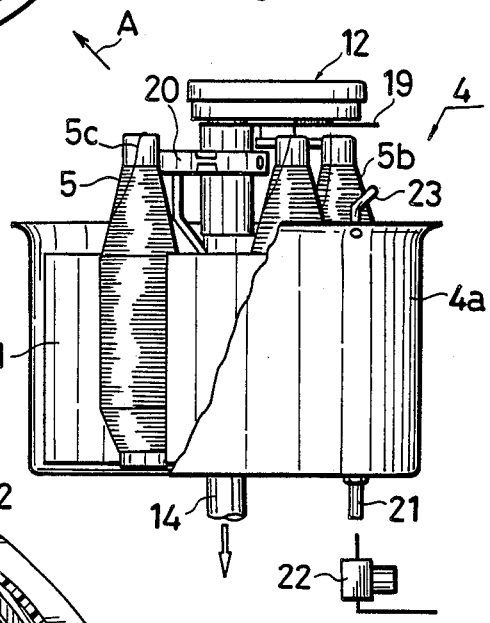
FIG. 6 is a side view showing the cop magazine when viewed in the direction of arrow (A) in FIG. 5.
Figure 15:
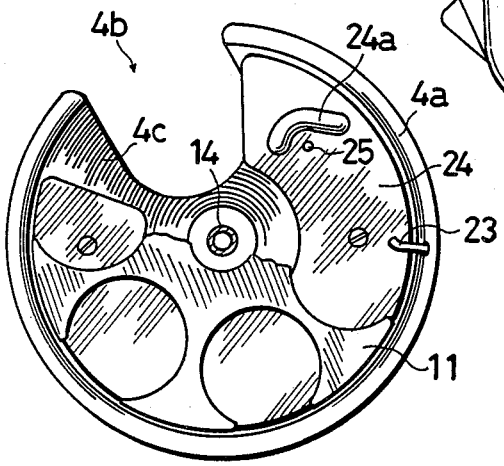
FIG. 15 is a bottom view showing the cop magazine.

Referring to FIG. 5 there is provided a cop magazine 4 having a cylindrical drum 4*a*, which includes recess 4*b* and a bottom 4*c*. A cop 5*b* is ready to fall, in which case it is desired to retain a yarn end under suction. To this end, the cylindrical drum 4*a* is specially provided with a bottom plate 24 shown in FIG. 15, which has such a shape as to cover the entire bottom surface except a recess 4*b* through which the cop falls. The bottom plate 24 is provided with an L-shape projection 24*a* having a length equal to the outside diameter of a bobbin. In addition an air injection port 25 is provided near the bent portion of the projection 24*a*. The projection 24*a* holds the cop in motion temporarily. As the projection 24*a*, a member produced in an extra process step can be provided which is bonded to the bottom 4*c* of the drum 4*a* as in the prior art. An air pipe 21 is connected to the injection port 25 as shown in FIG. 6. Air is supplied to the air port 25 through a valve 22. Under the present invention a suction cap 12 and a rotary blade 19 are provided, as shown in FIGS. 7 and 8.

Figure 7:
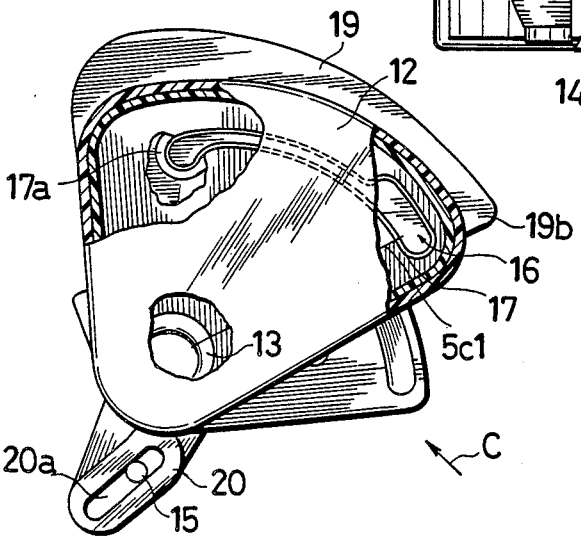
FIG. 7 is a plan view on an enlarged scale particularly showing the rotary blade.
Figure 8:
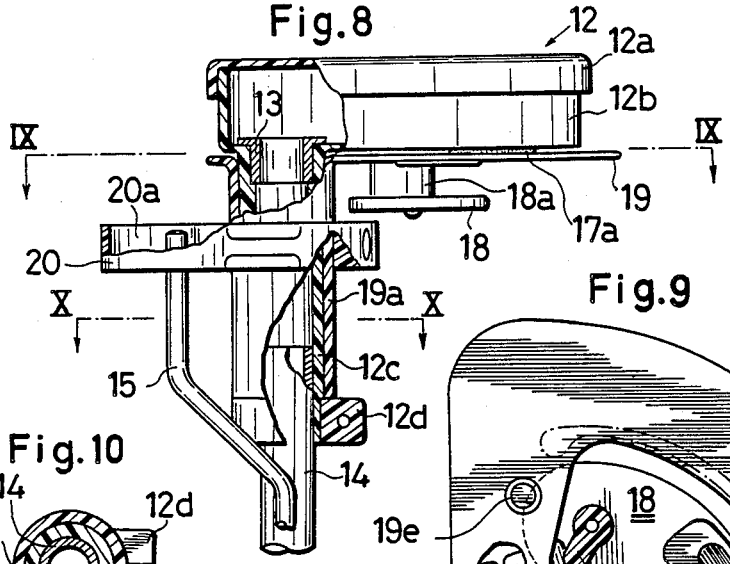
FIG. 8 is a side view showing part of the cop magazine when viewed in the direction of arrow (C) in FIG. 7.

Referring to FIGS. 7 and 8 the suction cap 12 is arcuate in shape includes a sector 12*b* and a cylindrical sleeve 12*c* provided at the root portion of the sector. The cylindrical sleeve 12*c* is grooved and reduced in diameter, and is fixed to a suction pipe 14 by means of a fastener 12*d*, the suction pipe 14 passing through a tube creel 11. The reference numeral 13 denotes a yarn guide ring provided between the sector 12*b* and the sleeve 12*c*. The guide ring 13 is preferably made of alumina porcelain. The sector 12*b* is airtightly covered with a lid 12*a*. The suction cap 12 is preferably made of plastics. The suction cap 12 is normally under negative pressure through the suction pipe 14. There can be many ways for providing the airtight contact between the section 12*b* and the lid 12*a*, but a fitting is preferred. The lid 12*a* can be made of a transparent material, through which the condition of the yarn inside can be watched. The suction cap 12 is provided with a slit 16 in its bottom surface. The slit 16 corresponds to the delivery section of the cops 5 stored in the cop magazine 4 and the top portion of the cop situated at a delivery-ready position of the magazine 4. The slit 16 is shaped in a semi-circle so as to follow the moving trace of the cop, and it is preferred that it has a widened part 16*a* for the cop situated at the delivery-ready position and a widened curved part 16*b* for the delivery position. A guide member 17 made of aluminum porcelain is inserted through the slit 16, and its projecting end portion is provided with a flange 17*a*, which projects toward the suction cap 12 and fixed thereto.

Figure 9:
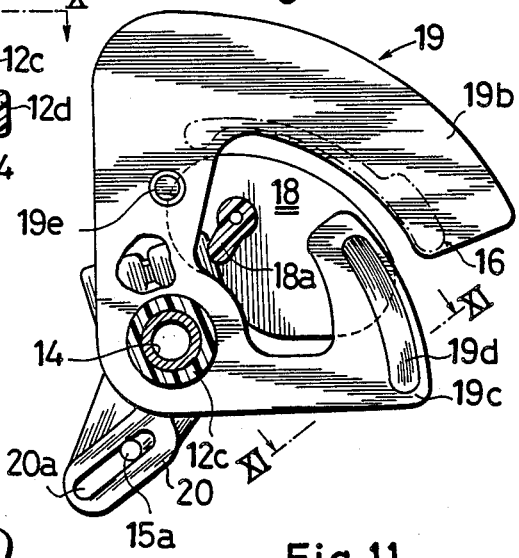
FIG. 9 is a cross-sectional view taken along the line IX—IX in FIG. 8.

The rotary blade 19 includes wing portions 19*b*, 19*c* and a cylindrical sleeve 19*a*, which are made in one piece with plastics. The cylindrical sleeve 19*a* rotatively receives the sleeve 12*c* of the suction cap 12, and is provided with an arm 20 having a slit 20*a*. A rotary rod 15 of the cop magazine 4 fits in the slit 20*a*. The rotary rod 15 is passed through a central bore in a tube creel 11, in such a manner as to enable it to rotate in accordance with the rotation of the tube creel 11. The blade 19 is located in such a manner that its wings 19*b*, 19*c* are slidable on the undersurface of the guide number 17. In FIG. 8 the reference numeral 18 denotes a guide plate fixed to the undersurface of the suction cap 12 by a fastener 18*a*. The guide plate 18 is to contact the top portions of the bobbins to guide them. As shown in FIG. 9 the wings 19*b* and 19*c* are spaced from each other. The shorter wing 19*c* is provided with a long depression 19*d* on its top surface. The depression 19*d* is intended to ensure that the shorter wing 19*c* retains a yarn end an the undersurface of the guide member 17 when the shorter wing 19*c* overlaps the slit 16. However the depression can be dispensed with. The blades 19*b*, 19*c* are shaped like a sickle with a view to imparting elasticity thereto and securing ready contact of them with the undersurface of the guide member 17. In FIG. 9 the reference numeral 19*e* denotes a projection which comes into abutment with a seat 12*e* produced on the bottom surface of the suction cap 12. The projection 19*e* maintains a space between the longer wing 19*b* and guide member 17 so as to reduce the friction when the wing 19*b* slides on the bottom surface of the guide member 17.

The rotary rod 15 is gradually rotated from the position 15*a* to the position 15*d* in the direction of arrow (a) in association with the rotation of the tube creel 11, and finally returns to the position 15*c* in the direction of arrrow (b). Again it rotates in the direction of arrow (c) to the position 15*d*, then to the position (c) in the direction of arrow (d), and stops at the position 15*b* temporarily after returning in the direction of (e). Finally it returns to the original position in the direction of arrow (f). The rotation of the rod 15 is effected through the operation of a cam mechanism provided in a yarn binding device 3 by operating a lever provided below the cop magazine. This rotation is repeated every time the tube creel 11 rotates pitch by pitch, that is, every time the cops fall one by one. In FIGS. 5 and 6 there is provided a cop guide 23 fixed to the drum 4*a*, the guide being adapted to guide the shoulder of every cop 5*b* which comes to the delivery-ready position, and to keep the top portion thereof in contact with the guide plate 18.

Figure 12:
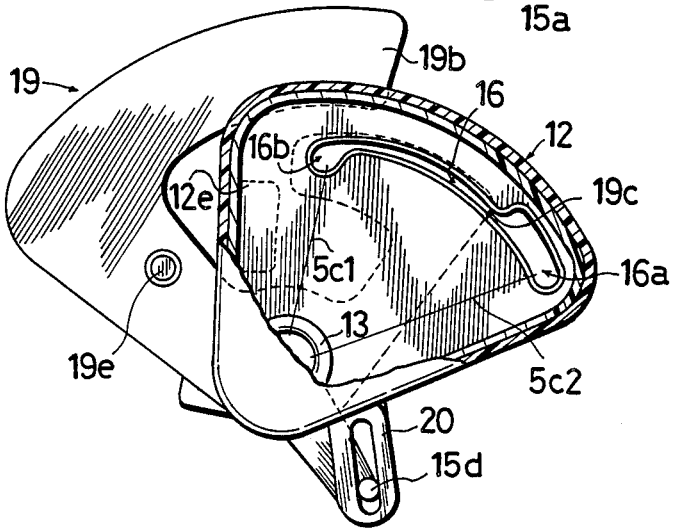
FIG. 12 is a plan view, partly broken, showing the part of cop magazine shown in FIG. 8.
Figure 11:
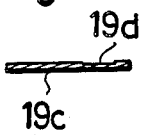
FIG. 11 is a cross-sectional view taken along the line XI—XI in FIG. 9.

In operation, the rotary rod 15 in FIG. 9 is at rest at the original position 15*a*, and the tube creel 11 is also stationary, wherein the top portion of the cop 5*b* at the delivery-ready position is engaged in the widened part 16*a* of the slit 16 (FIG. 12) in the suction cap 1. The top yarn end 5*c* is sucked into the suction cap 12 through the widened part 16*a*, and the longer wing 19*b* of the blade 19 entirely closes the slit 16. The cop 5*b* at the delivery-ready position is shifted to the delivery position in accordance with the rotation of the tube creel 11. This causes the rotary rod 15 to rotate in the direction of arrow (a) in FIG. 10, and the blade 19 to rotate as shown in FIG. 12 so as to keep the longer wing 19*b* out of the slit 16. In turn the shorter wing 19*c* closes the slit 16. The cop 5*b* is caused to rotate in the direction of arrow (a) until it falls into recess 4b. Then the cop 5b is delivered to the winding position through a chute 6.

The yarn 5c which was set into the top opening of the bobbin and sucked in the widened part 16a of the slit 16 starts to move in the slit 16 which is made free from the longer wing 19b, and comes to the widened part 16b.

When the cop 5b comes to the delivery position, the shorter wing 19c closes the widened part 16b, and the yarn end thereof is attracted to the flange 17a of the guide member 17 under suction, thereby holding the yarn end 5c1. The attraction is facilitated by the long depression 19d.

Figure 10:
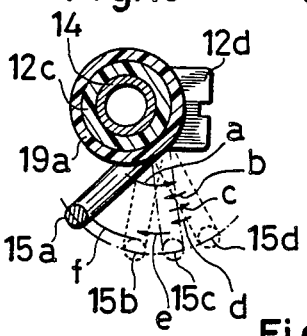
FIG. 10 is a cross-sectional view taken along the line X—X in FIG. 8.

When the rotary rod 15 rotates as shown by the arrow (a) in FIG. 10, the rotation of the tube creel 11 is finished.

As shown in FIG. 12 the shorter wing 19c is shorter than the length of the slit 16, and its top portion tends to close the cop delivery section, thereby making the widened part 16a free so as to allow the sucking power to pass through. In this way the yarn end 5c situated thereabout is sucked into the suction cap 12 until the yarn is placed in a state indicated by 5c2. In synchronism with this operation the valve 22 is opened to introduce a jet into the intake port 25, thereby ensuring that the yarn end 5c enters the suction cap 12.

With the yarn end being retained the cop 5 is delivered through the chute 6. In this case the yarn tends to slacken, and it often happens that the arm 3c fails to hold the yarn end. To avoid this the rotary rod 15 is slightly returned to the position 15c indicated by the arrow (b) in FIG. 10. As a result the slit 16 is completely opened temporarily, thereby releasing the yarn end 5c1 from the widened part 16b, and allowing it to enter the suction pipe 14 in which the yarn is kept under tension.

When the rotary rod 15 rotates in the direction of arrow (c) in FIG. 10 and comes to the position 15d, the state shown in FIG. 12 is restored. The yarn end 5c1 held in the widened part 16b is prevented from entering the suction pipe in excess. At this time the cop 5b situated at the delivery-ready position is again subjected to the jet introduced through the nozzle 25 by opening the valve 22. In this way the yarn end or ends 5c which failed to enter the suction cap 12 at the previous stage shown in FIG. 12 are led into the suction cap 12.

Figure 13:
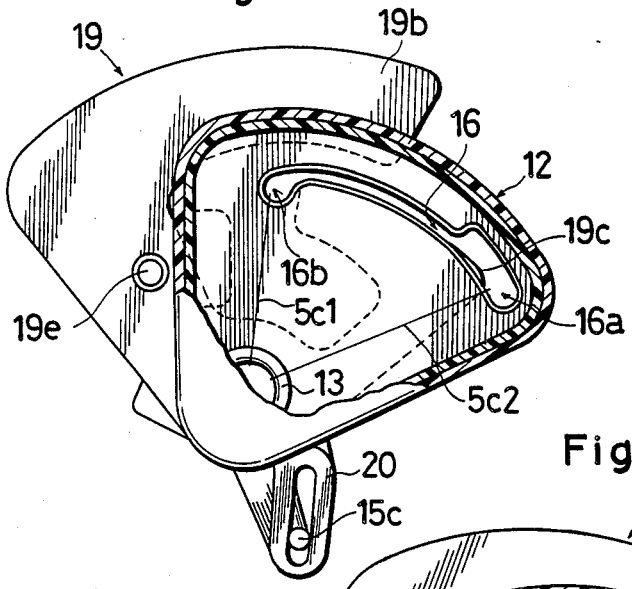
FIGS. 13 and 14 are explanatory views exemplifying the operation of the rotary blade shown in FIG. 12.
Figure 14:
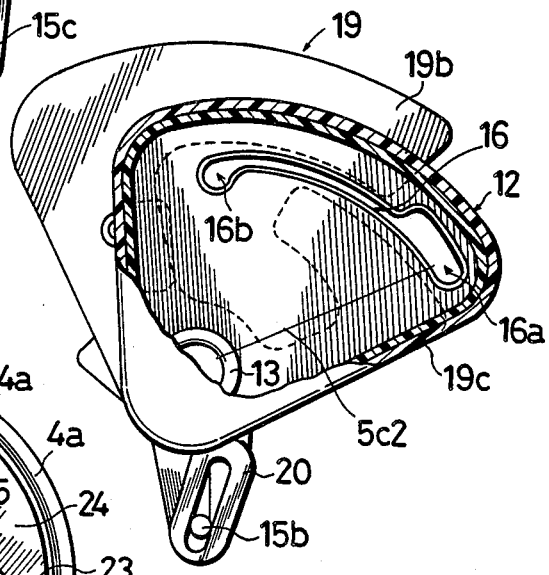

The rotary rod 15 is returned in the direction of arrow (d), and comes to the position 15c, where, as shown in FIG. 13, the yarn end 5c1 is introduced into the suction pipe 14 from the widened part 16b and kept under tension. At this stage the yarn binding device 3 is operated to bind the yarns, and the yarn ends are cut. When the rotary rod 15 is returned in the direction of arrow (e) in FIG. 10, and comes to the position 15b (FIG. 14), the slit 16 is completely opened temporarily, thereby allowing the yarn pieces which have been cut to enter the suction pipe 14 under suction.

The rotary rod 15 is returned in the direction of arrow (f) in FIG. 10 and the state shown in FIG. 9 is restored. The position 15a is maintained until the tube creel 11 is rotated.

According to the present invention the yarn end is retained under suction; the caught yarn end is shifted to the delivery position through which the cops fall; the yarns are bound under tension, and the yarn pieces which have been cut are disposed of, all these operations being automatically performed. In addition the construction is simplified and the operation can be easily performed.

What is claimed is:

1. A cop magazine for use in association with an automatic winding apparatus, the cop magazine comprising:

an open-topped cylindrical drum;

a tube creel provided inside the cylindrical drum, the creel including cells adapted to house a plurality of cops individually;

means for rotating the tube creel intermittently cop by cop;

a suction cap provided at the top end of a suction pipe passed through the tube creel, the suction cap including a slit faced to a delivery-ready position and a delivery position in the tube creel;

a rotary blade for opening and closing the slit so as to release and retain the yarns; and means for operating the rotary blade in association with the rotation of the tube creel.

2. A cop magazine as defined in claim 1, wherein the rotary blade comprises first and second rotary plate members wherein the first member selectively closes and opens an entire opening of the slit, and the second member selectively closes and opens that part of the slit in which the cop delivery position is located, the first and second plate members being spaced from each other so as to avoid friction.

3. A cop magazine as defined in claims 1 or 2, wherein the rotary blade is made of such a thin plate as to be liable to negative pressure within the suction cap and be attracted to the slit, thereby ensuring that the yarn led therein is retained.

4. A cop magazine as defined in claims 1 or 2, wherein the slit includes a first widened part curved toward a yarn end suction side, and a second widened part extended outward for the delivery-ready position.

5. A cop magazine as defined in claim 1, further comprising a guide member having a periphery shaped along the slit, the guide member being located adjacent the rotary blade.

6. A cop magazine as defined in claim 1, wherein said suction cap is arcuate in shape.

7. A cop magazine as defined in claim 1, wherein said slit is formed in a bottom surface portion of said suction cap.

8. A cop magazine as defined in claim 1, wherein said rotary blade comprises first and second wing portions wherein one of said first and second wing portions overlaps said slit.

* * * * *